US010392856B2

(12) United States Patent
Clarke, Jr. et al.

(10) Patent No.: US 10,392,856 B2
(45) Date of Patent: Aug. 27, 2019

(54) MULLION FOR USE WITH NARROW STILE DOORS

(71) Applicant: Frame & Mullions LLC, Henrico, VA (US)

(72) Inventors: James Thomas Clarke, Jr., Henrico, VA (US); Ira Rex Seybold, Mechanicsville, VA (US)

(73) Assignee: Frame & Mullions LLC, Henrico, VA (US)

( * ) Notice: Subject to any disclaimer, the term of this patent is extended or adjusted under 35 U.S.C. 154(b) by 0 days.

(21) Appl. No.: 16/101,960

(22) Filed: Aug. 13, 2018

(65) Prior Publication Data

US 2019/0063142 A1 Feb. 28, 2019

Related U.S. Application Data

(60) Provisional application No. 62/548,995, filed on Aug. 23, 2017.

(51) Int. Cl.

| | |
|---|---|
| ***E06B 1/52*** | (2006.01) |
| ***E06B 1/04*** | (2006.01) |
| ***E06B 1/18*** | (2006.01) |
| ***E04B 1/24*** | (2006.01) |

(52) U.S. Cl.

CPC ..... *E06B 1/524* (2013.01); *E06B 1/045* (2013.01); *E06B 1/18* (2013.01); *E04B 2001/2445* (2013.01); *E04B 2001/2472* (2013.01)

(58) Field of Classification Search

CPC ... E06B 1/14; E06B 1/18; E06B 1/045; E06B 1/524; E06B 1/528; E06B 2/967; E06B 3/362; E06B 3/365; E04C 3/32

See application file for complete search history.

(56) References Cited

U.S. PATENT DOCUMENTS

| | | | | |
|---|---|---|---|---|
| 3,319,382 A * | 5/1967 | Hand | ..... | E04C 3/30 49/365 |
| 5,765,309 A * | 6/1998 | Mamchych | ..... | E06B 1/524 49/365 |
| 2004/0182009 A1* | 9/2004 | Flory | ..... | E06B 1/524 49/365 |

(Continued)

FOREIGN PATENT DOCUMENTS

WO WO-0060185 A1 * 10/2000 ..... E04B 2/7455

*Primary Examiner* — Christine T Cajilig

(74) *Attorney, Agent, or Firm* — John H. Thomas, P.C.

(57) ABSTRACT

A mullion is adapted for use in a narrow stile door system. The mullion is a three-section mullion with top and bottom hollow mullion tubes and an I-shaped centerpiece. The top and bottom hollow mullion tubes have a first outside width and first outside depth and a second inside width and second inside depth, the second inside width and depth defined by the inside of the hollow tube walls. The I-shaped centerpiece is connected to and fixed in between the top and bottom mullion tubes. The I-shaped centerpiece comprises a thin middle portion and top and bottom flanges, and top and bottom insert portions connected to the top and bottom flanges, and the top and bottom insert portions having a third width and third depth that are smaller than the second inside width and depth of the top and bottom hollow mullion tubes, with the insert portions adapted to be inserted into the hollow portion of the top and bottom mullion tubes and fixed therein.

12 Claims, 7 Drawing Sheets

(56) References Cited

U.S. PATENT DOCUMENTS

2009/0304440 A1* 12/2009 Wang ..... E06B 1/18
403/252
2012/0110913 A1* 5/2012 Greenfield ..... E06B 1/524
49/365
2016/0024805 A1* 1/2016 Graziano ..... E04C 3/00
428/34.1

* cited by examiner

MULLION FOR USE WITH NARROW STILE DOORS

This application claims the benefit of U.S. Provisional Patent Application No. 62/548,995, filed Aug. 23, 2017, incorporated by reference herein in its entirety.

The present invention is directed to a mullion for use with a pair of narrow stile and rail doors. Stiles are the vertical members of doors and the rails are the horizontal members. The stiles provide the structural frame work for the installation of glass of various thicknesses in the door as well as mounting surfaces for locking devices, door closers and other hardware required at the opening. A unique, I-shaped centerpiece insert portion of a mullion enables the use of regular or electric strikes mounted on opposite sides of the mullion installed behind the meeting stiles of pairs of doors. Panic or exit devices of various kinds latch into these strikes in order to lock or latch the doors.

BACKGROUND

Narrow stile pairs of doors present challenges with respect to the use of rim panic devices mounted on the inside faces of the vertical stiles and where the latching mechanisms latch into strikes mounted on each side of the center mullion. Because these doors by definition have narrow stiles, there is not enough stile width on these doors to mount standard rim mounted panic or exit devices which have wider latch cases that would protrude over the glass beyond the stile toward the hinge side. An alternative solution is to lock the doors with vertical rod devices with narrow width latch stile cases that have latching mechanisms that secure the doors at the top and bottom of the opening. There are two kinds of these vertical rod latch systems in use on narrow stile doors. One of them has the rods concealed in the doors on the lock stile side, and the other has vertical rods that are mounted to the surface of the doors on the lock stiles side.

In both cases these vertical rod assemblies are more costly to buy, install and maintain than rim mounted panic devices where the latching mechanisms lock the doors at the center of the devices. Also because vertical rod devices have more operating components, the doors are more subject to mechanical failure under normal use. When surface mounted vertical rod devices are used, they are especially prone to be damaged when the bottom or top latch cases are struck and loosen, or knocked off, by large objects moving through the openings. This damage can also happen to the bottom strikes on these devices since they may be surface mounted on top of a flat threshold. The strikes also constitute a tripping hazard as they project upward from the floor into the path of travel through the opening.

Where concealed vertical rods are used security issues arise if their bolts fail to lock into place at the top of the doors, and especially at the bottoms of the doors. To secure the doors at the bottom, the bottom rods of these devices have to drop into place in the bottom strikes in the floor or, into holes drilled into a threshold. This becomes a security issue when dirt gradually accumulates in the holes or when a foreign object is lodged in the hole. It will prevent the bottom bolts from falling into place to lock the door. Depending on the actual hardware installed, this could create issues that allow the doors to be opened in unauthorized ways. However, when endeavoring to use mullions with center latching rim panic devices on narrow stile doors, there is the constraint of space needed between the mullion and the latch cases of the panic or push bar.

On doors with wider stiles that require panic devices and electric strikes with wide latch cases, then there should be no problems. Existing standard and electric mullions in the industry are hollow and offer a pathway for wiring to the electric strike system to provide power to the electric strikes.

SUMMARY

Accordingly, it is an object of the present invention to provide a mullion that overcomes the foregoing challenges and problems. Specifically, the mullion described herein has a center section that includes a thin middle portion. The thin middle portion can accommodate the use of narrow stile doors that use electric strikes behind them mounted on the thin portion of the mullion. These mullions could possibly be a single piece structure, or they could alternatively be a three-piece structure with an I-shaped centerpiece between top and bottom hollow mullion tubes mounted on either vertical side (top and bottom) of the centerpiece.

In one example, a mullion adapted for use in a narrow stile door system has a rectangular cross section with a first width, first depth and first height, and a flat front face that is adapted to face a door stile. The mullion includes an I-shaped center section of the mullion having a thin, middle portion, wherein the depth of the I-shaped center section has a second depth that is approximately the same as the first depth of the rest of the mullion; wherein thin, middle portion of the mullion has a second width of about $3/8^{th}$ to one inch, the first depth is in the range of about 2 to 4 inches, and the middle portion of the mullion has a second height of about 8 to 12 inches. The mullion is comprised of a single, monolithic piece of metal. The mullion may further comprise a security stud that protrudes perpendicularly from the flat front face of the mullion and proximate, but not from, the I-shaped center section of the mullion. The middle portion of the mullion may have a second width of about ½ of an inch.

In another example, a mullion adapted for use in a narrow stile door system is a three-section mullion comprising top and bottom hollow mullion tubes and an I-shaped centerpiece. The top and bottom hollow mullion tubes have a first outside width and first outside depth and a second inside width and second inside depth, the second inside width and depth defined by the inside of the hollow tube walls. The I-shaped centerpiece is connected to and fixed in between the top and bottom mullion tubes, and further comprises a thin middle portion and top and bottom flanges, and the centerpiece further comprising top and bottom insert portions connected to the top and bottom flanges, and the top and bottom insert portions having a third width and third depth that are smaller than the second inside width and depth of the top and bottom hollow mullion tubes, with the insert portions adapted to be inserted into the hollow portion of the top and bottom mullion tubes and fixed therein. The centerpiece may be a single, monolithic component. Additionally, the mullion centerpiece may comprise three components—top and bottom insert blocks and an I-shaped center portion, wherein the I-shaped center portion has the top and bottom flange portions on the top and bottom of the thin middle portion and the top and bottom insert blocks fixed to the top and bottom flanges on the opposite side of the flanges from the middle portion, whereby the top and bottom insert blocks form the insert portions of the centerpiece. The thin middle portion may have an aperture therethrough its width and inside a depth and height of the middle portion to form the aperture. The mullion may also include a conduit channel that is an opening that extends from the top of an insert portion, through the flange and into the aperture in the middle portion, whereby the conduit channel is a pathway for electrical wiring. The centerpiece may be formed of metal. The thin middle depth may be substantially the same as the first outside depth of the top and bottom mullion tubes. The height of the thin middle may be in the range of about 8 to 12 inches. The mullion may further comprise a security stud, wherein the top and bottom mullion tubes have substantially flat front width faces adapted to face a door stile, and wherein the top and bottom flanges each have flat front faces adapted to face a door stile, and the flange faces and the mullion faces are substantially parallel to each other, and the security stud protrudes perpendicularly from the flat front face of the top flange. Additionally, the mullion may further comprise a security stud, wherein the top and bottom mullion tubes have substantially flat front width faces adapted to face a door stile, and wherein the top and bottom flanges each have flat front faces adapted to face a door stile, and the flange faces and the mullion faces are substantially parallel to each other, and the security stud protrudes perpendicularly from the flat front face of the bottom flange. Still further, the mullion may comprise a plurality of security studs extending perpendicularly from the flat front face of the top flange.

BRIEF DESCRIPTION OF THE DRAWINGS

FIG. 3A is a perspective view, FIG. 3B is a front view, and FIG. 3C is a side view of the portion of one example of the mullion.

FIG. 5A is a perspective view, FIG. 5B is a front view, and FIG. 5C is a side view of the portion of one example of the mullion.

DETAILED DESCRIPTION

The unique mullion described herein has an I-shaped centerpiece or thin middle portion that creates space for the installation of strike mechanisms mounted on mullions used with pairs of narrow stile doors. In order to install electric strikes on the mullions, the mullion must be narrow enough at the panic device to allow for spacing between the latch case and the electric strike on the mullion so the doors will close and latch on the electric or conventional strike. In the example of an I-shaped centerpiece, wiring pathways to the electric strikes on narrow stile electric mullions with inserts are made available via an access hole bored down through the top of an insert into a wire pocket/aperture in the center at the middle portion of the insert. There in the wire pocket, a wire can be connected to the electric strikes. With this arrangement, once the centerpiece has electric strikes mounted onto it at the thin middle portion, no wire is exposed in the assembly.

For the purposes of this disclosure, a narrow stile door is one with a comparably narrow stile width of 1 and ¾ inches to 3 inches. While these narrow stile doors are believed to benefit most from the I-shape mullion centerpieces described herein, other doors having various stile widths between about one and one-half inches up to about seven inches could also advantageously deploy an I-shape centerpiece.

The I-shaped centerpiece includes a thin middle portion with top and bottom insert blocks with or without extensions fixed on opposite top and bottom ends of the thin portion. The inserts are blocks with exterior dimensions that allow the insert to fit inside the top and bottom, rectangular hollow tubular mullion segments above and below the centerpiece. In other words, the outside width and depth dimensions of the insert blocks are less that the inside width and depth dimensions of the hollow mullion tubes into which they are fit. Additionally, optional flat bar extensions, also sized to be received inside the top and bottom hollow mullion tubes, may be welded or otherwise fixed to each top and bottom end of the thin middle portion. These extensions are designed to provide extra vertical stability for the mullion. Still further alternatively, the insert portions at the top and bottom of the centerpiece may have relatively shorter or longer lengths to engage the hollow mullion tube portions and provide more or less stability to the mullion as desired or required.

Figure 3C:
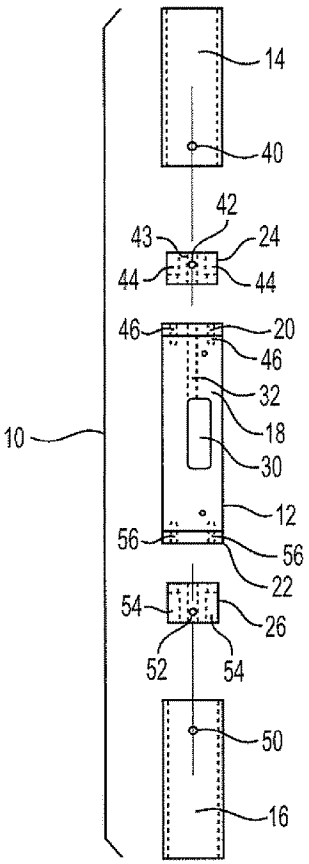
FIGS. 3A-C are exploded views of a portion of one example of a mullion as described herein.
Figure 3B:
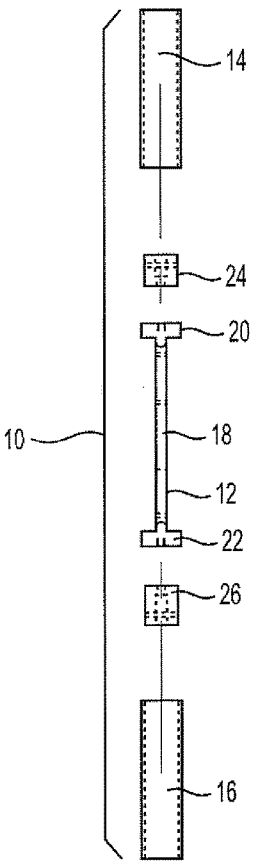
Figure 3A:
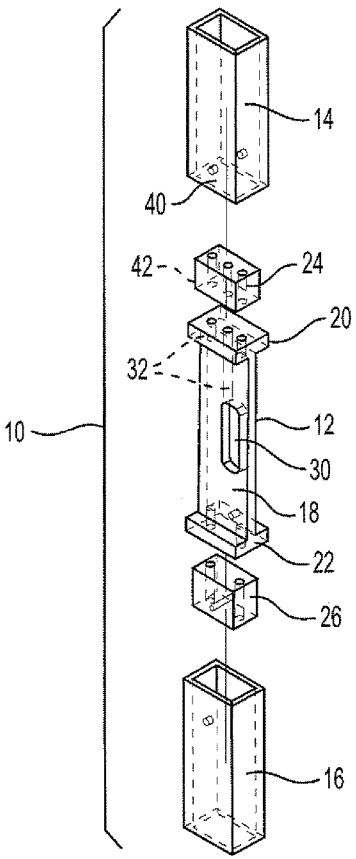

Also due to the practical necessity to cut and install the I-shaped centerpiece, the vertical stability of the mullion has to be regained in order to secure the opening. This is partially accomplished by the flat bar extensions mentioned above. Two other components may also be included in order to provide the improved rigidity and vertical stability. The first is the inclusion of four security screws in the center of the door edge of the insert to limit the movement between the top and bottom of the mullion segments and the I-shaped centerpiece. In one example, two Phillips flat head stainless steel machine screws, no less than ¼-20×1 inch, are to be installed, and counter sunk, through the walls of mullion segments and threaded into blocks 24 and 26 just above and below the joints at flanges 20 and 22 as shown in FIGS. 3A-3C.

The second component to improve stability is the inclusion, in one example, of two stainless steel security studs 124 installed into the door edge of flange 109. See FIGS. 5A-5C. The ¼-20×1 inch studs are threaded on one end and project out toward the face of the door at the lock stiles. When the doors shut the studs will protrude into a metal grommet in the face of the door stile with holes designed to receive the stud. Instead of a grommet, alternatively, a hole may simply be drilled into the face of the door stile with the simple hole adapted to receive the stud. This use of a stud with a grommet or hole will limit any horizontal flex in the mullions when/if attempts are made to pull the doors open. There will be no mullion flex in either direction of the doors.

The inserts of the center I-shaped centerpiece also have flanges with width and depth dimensions that substantially match the exterior dimensions of the hollow mullion tubes. The flanges prevent the tubes from having any vertical movement over the insert. The actual thickness of the thin middle portion of the I-shape centerpiece may be selected based on door specifications generally or otherwise based on custom chosen specification thickness. In currently conventional narrow stile door systems, the mullion has a width of about 1 and ¾ inches to 2 and ⅞ inches. In one example, the thickness of the thin middle web is about ½ inch with about a ½ inch inset from each side of the flange widths. Commercially available ½ or ¾ inch thick strike mechanisms can then be mounted on each side of the I-shape centerpiece to receive latching mechanisms from a center latching panic device. As noted, the middle thin section of the I-shape centerpiece is about ½ inch in width. For other applications, this thin middle portion could be about ⅜ inches up to about 2 inches. The height of the thin middle portion is in the range of about 8 to 12 inches depending on the height of the strike device that will be mounted on the thin middle portion. The electric strikes may be provided with spacer plates to facilitate field installation.

While the I-shape centerpiece may be used with conventional, mechanical center latch mechanisms, the centerpiece may be further modified for use with an electric strike mechanism. The hollow tube of the regular top and bottom mullion tube portions of the mullion enable wiring to be inserted through them. However, to allow wiring to extend into the I-shaped centerpiece, a conduit channel is bored through the top (or bottom) insert block and flange portions of the centerpiece and also downwardly through the thin middle portion of the centerpiece. An aperture is cut out of the middle portion to form a wire pocket, and the conduit channel is in open communication with the aperture. Therefore, wiring may be fed through the top (or bottom) hollow mullion tube, through the conduit channel, and into the aperture/wire pocket where the wire becomes accessible but concealed in the aperture in the I-shaped center piece at the back of the electric strike mechanisms fixed on each side of the centerpiece. From the top of the full mullion down through the I-shape centerpiece elements including the block and flange, the wiring of the electric strike is concealed and protected from tampering and environmental damage.

As noted earlier, a single-piece mullion having a thin middle portion may be used with conventional, mechanical center latch mechanisms. This provides the same benefits as the I-shaped centerpiece in the three-piece mullion. There would be challenging fabrication issues, but such a mullion could be formed for the conventional mechanisms.

Figure 1:
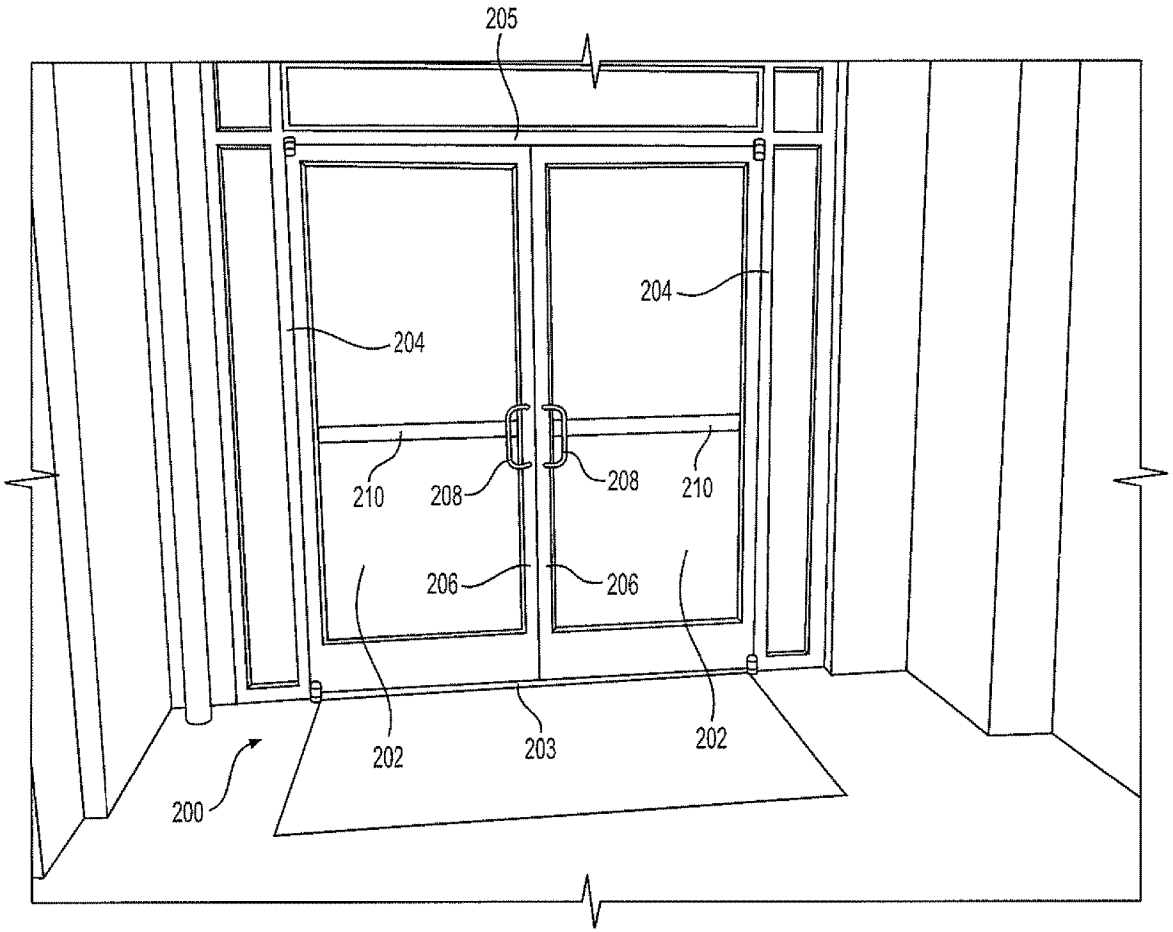
FIG. 1 is a perspective view of a doorway having narrow stile doors mounted therein with the doors in the closed position.
Figure 2:
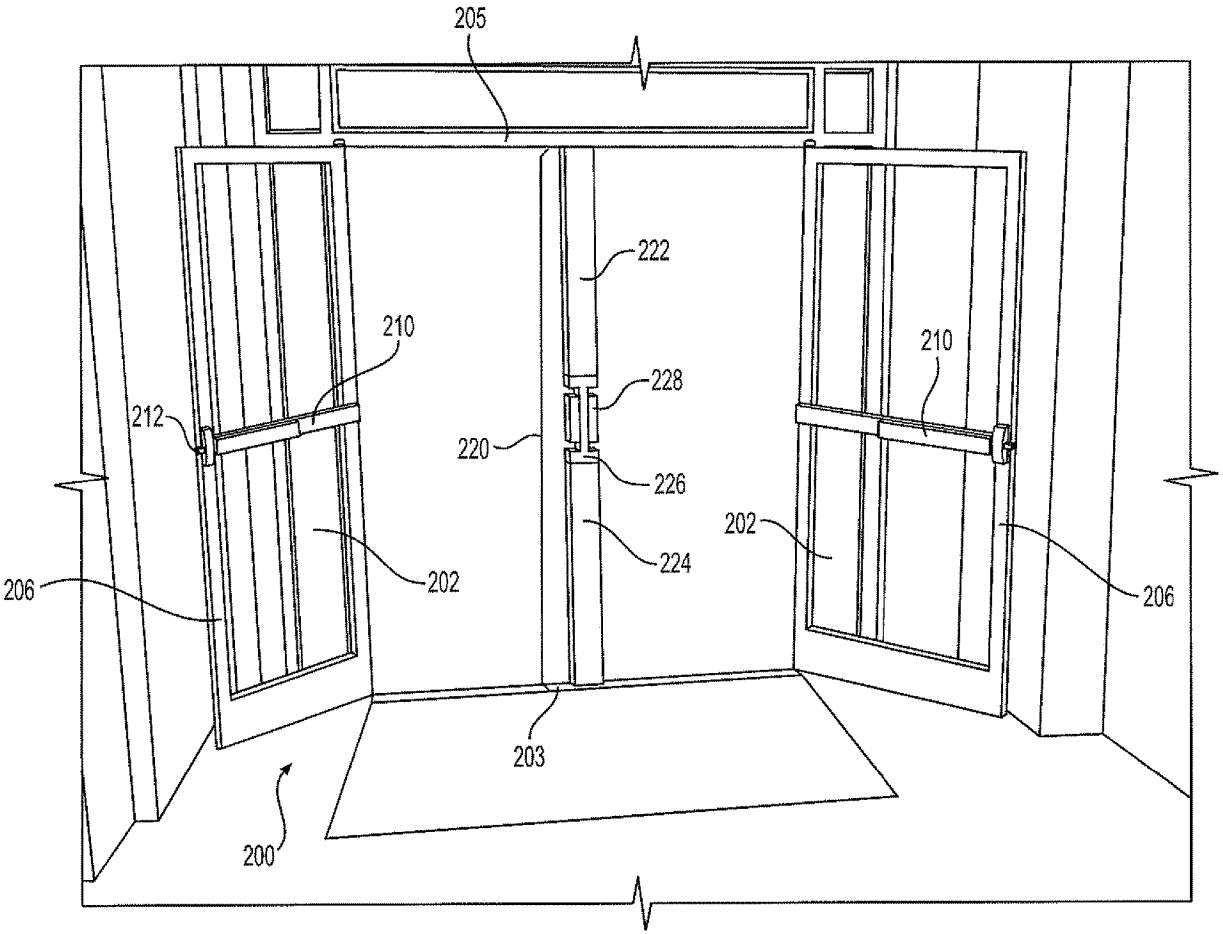
FIG. 2 is a perspective view of the same doorway as shown in FIG. 1, except the doors are in an open position and a mullion as described herein that is positioned in the middle of the doorway is visible.

Turning now to FIGS. 1 and 2, there is shown environmental views of a door system 200 that includes an example of the mullion 220 as described herein. In FIG. 1, the doors 202 are shown in the closed position so that no mullion is visible in this front view. The door system 200 has vertical frames members 204, a header piece 205 and a threshold 203 that form the supporting structure around the doors 202. The doors 202 further have handles 208 on the outside of the doors and push bar mechanisms 210 inside the doors around the middle of the doors. As seen in FIG. 1, the doors have qualitatively narrow stiles 206. When the doors 202 are open as in FIG. 2, the mullion 220 is revealed that was behind the stiles 206 in FIG. 1.

In FIG. 2, the mullion 220 is shown having three sections, a top hollow, rectangular tube 222, a bottom, hollow rectangular tube 224 and an I-shaped centerpiece 226. Mounted on each side of the centerpiece 226 are strike mechanisms 228 that are adapted to engage the latches 212 on the push bar mechanism 210 to hold the doors 202 closed. The strike mechanisms 228 may be conventional mechanical types of mechanisms or they may be electrical style mechanisms.

In FIG. 2, the mullion 220 has the three sections as shown. Alternatively, as discussed earlier, a mullion could be a single piece structure or a two-piece structure. A single piece or two-piece mullion would look just like that three-piece mullion 220 shown in FIG. 2, except there would be no seams in between the three pieces—the single piece would be just that, a single piece having a thin middle portion. A two-piece mullion would have a single seam at the top or bottom of the thin middle portion with the other side being solid and monolithic with the middle portion. In either the single piece or two-piece options, there would likely be fabrication challenges, but they could be managed.

FIGS. 3 A-C illustrate exploded views of a mullion 10 that includes an I-shape centerpiece 12. A top mullion segment 14 and bottom mullion segment 16 represent hollow, rectangular metal tubes that are conventional mullion construction. In a typical mullion (not shown), the mullion would be a single hollow rectangular tube having a length to fit from the threshold of a doorway all the way to the underside of the header of a doorway. The mullion 10 described herein has generally three sections, the top section 14, the bottom section 16, and the I-shaped centerpiece 12. Therefore, each section can be adjusted in length, typically the top and bottom sections 14 and 16, to fit a particular doorway and to position the centerpiece 12 at the desired height for a door latch in generally the middle of the doorway.

The mullion 10 described herein is designed for use with a pair of doors. The mullion sits in the middle of the opening behind the doors. In some situations, depending on the function of the security system, electric strikes may only be required for one of the two door leaves of the centerpiece described. In that case a ¾" high conventional mechanical strike would have to be installed on the other side of the mullion in order to latch the other door leaf.

Turning again to the FIGS. 3A-C, the I-shaped centerpiece 12 includes a top flange 20, bottom flange 22 and a thin middle portion 18. Attached to the top flange 20 is an insert block 24. Attached to the bottom flange 22 is insert block 26. The flange and block in each case form the top and bottom insert sections of the I-shape centerpiece 12. Dimensionally, the insert blocks 24 and 26 have a width and depth measured to be a little smaller that the inside width and depth dimensions of the hollow top and bottom mullion segments 14 and 16. Therefore, these insert blocks 24 and 26 slide into the top and bottom mullion portions 14 and 16 respectively. Lock screw holes 40 and 50 in the sidewalls of the top and bottom mullion segments 14 and 16 respectively line up with screw holes 42 and 52 in the top and bottom insert blocks 24 and 26. In this way, the insert blocks 24 and 26 may be secured to and fixed in place with the mullion segments 14 and 16 to form the single mullion 10 of the doorway.

The top insert block 24 includes screw holes 44 that align with screw holes 46 in the top flange 20. Similarly, the bottom insert block 26 has screw holes 54 that align with flange screw holes 56 that enable the insert block to be secured to the flange 22. The width and depth dimensions of the flanges 20 and 22 are designed to be close to the same or the same as the outside width and depth dimensions of the top and bottom mullion segments 14 and 16. This prevents the I-shape centerpiece for inserting too far into the top and bottom mullion portions 14 and 16 and allows the flanges 20 and 22 to bear the vertical weight of the assembled mullion 10.

The example illustrated herein describes insert blocks fixed to the tops of the flanges. Alternatively, the centerpiece could be a single monolithic piece of metal. It would look the same as the assembled centerpiece illustrated in FIGS. 3A-C.

The thin middle portion 18 of the centerpiece 12 has a depth dimension that is substantially the same as the depth dimension of the cross-section of the mullion segments 14 and 16. This depth dimension could be less, but the substantially full dimension provides additional structure and strength to the centerpiece 12. The thickness of the middle portion 18 is designed so that door strike mechanisms may be mounted on each side of this portion and not extend outwardly from the general width of the mullion 10. This thickness may be as thin as needed and allowed but not so thin as to compromise the vertical strength necessary to maintain the integrity of the mullion. Typically, this thin middle section 18 is solid metal.

The middle section 18 may be solid in order to adapt it for use when mechanical strikes are mounted on each side when no electric strikes are required. Alternatively, however, as shown in the FIGS. 3A-C, the middle section 18 may include having aperture 30 removed from it. Moreover, the top insert block 24 has a conduit channel 42 formed in it that aligns with a second conduit channel 32 that extends through the top surface of the top flange 20 and extends downwardly through to the aperture 30. In this way, electrical wiring may be threaded through the top mullion segment 14, the top insert block 24, and the middle portion 18 of the I-shaped centerpiece 12 to be available to the electric strikes that could then be mounted on opposite sides of the thin portion of the centerpiece.

In one specific example, an I-shaped centerpiece has a thickness of the thin middle section of one-half of an inch. This dimension can be reduced to ⅜" for use with door stiles that are only 1¾" wide. The inset on each side of this centerpiece middle section is one-half inch or ⅝" if the web is reduced to ⅜". An electric strike mechanism may have one-half of an inch in thickness. Electric strikes that are ¾" in height can also be utilized if required.

Figure 4:
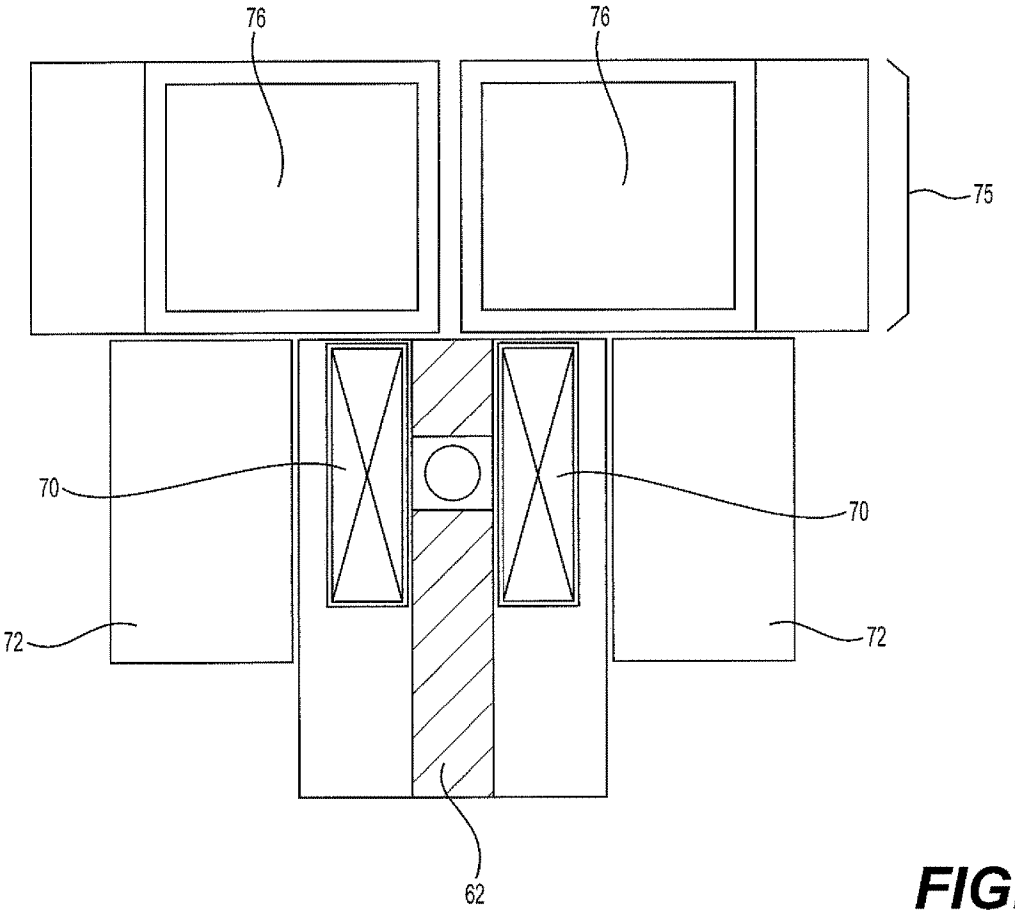
FIG. 4 is a top, cross-sectional view of a mullion as described herein set behind a pair of narrow stile doors with the cross-section at the middle height of the doors.

FIG. 4 illustrates a top view of a cross-section of a door assembly as shown in FIGS. 3A-C in the environment of doors 75 and stiles 76. The thin middle portion 62 is shown with the electric strike assemblies 70 shown mounted on opposite sides of the middle portion, Additionally, however, the doors 75 are shown in the example of narrow stile doors. The panic device latch mechanisms 72 are shown as mounted on the doors 75 and adjacent the electric strikes 70. The actual latches between 72 and 70 that extend into the strike cavities are not shown in this cross-section.

Figure 5C:
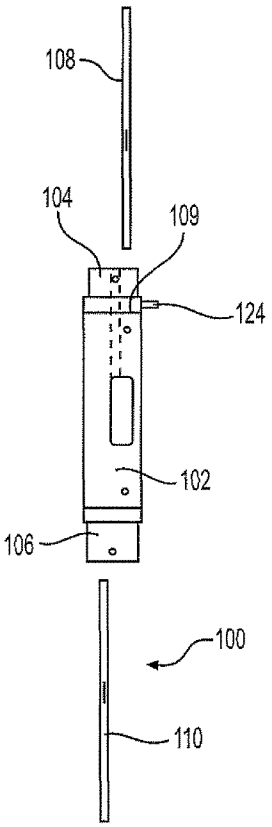
FIGS. 5A-C are exploded views of a portion of a second example of a mullion as described herein.
Figure 5B:
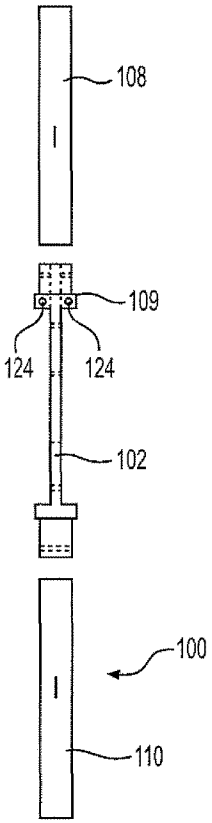
Figure 5A:
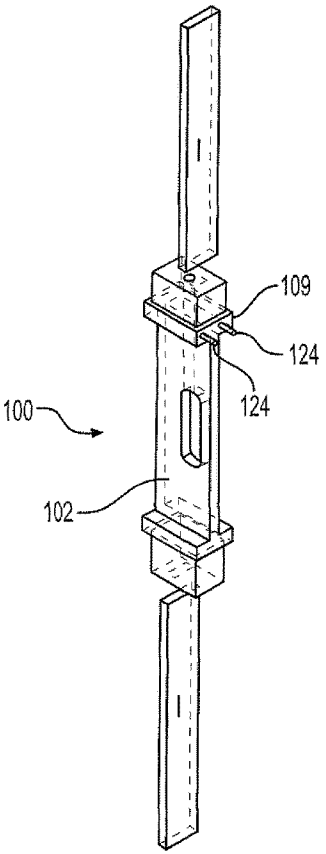

FIGS. 5A-C show three exploded views of an alternative construction of a mullion 100. The I-shaped centerpiece 102 includes insert portions 104 and 106 that are integral to the centerpiece 102. Instead of separate insert blocks as shown before, the centerpiece 102 with the top and bottom inserts 104 and 106 is machined from a single piece of metal. The insert portions 104 and 106 are shown as qualitatively short. They may alternatively be lengthened to extend more deeply into the hollow mullion tubes above and below the centerpiece (not shown here).

In a still further alternative shown in FIGS. 5A-C, extension stabilizers 108 and 110 may be attached to the inserts 104 and 106 respectively. By attaching the hollow mullion portions (not shown) to the top extension 108 and bottom extension 110, inside the hollow portions of those mullion tubes, the resulting mullion has greater stability. These flat extensions may be about 4 to 24 inches in length to stabilize the assembled mullion.

FIGS. 5A-C also illustrate security studs 124 that extend perpendicularly from the front face 109 of the top flange of the centerpiece 102, with the perpendicular orientation measured relative to the vertical orientation of the centerpiece and an assembled mullion when in place. The security studs 124 are adapted to insert into grommets or holes drilled and countersunk in the back of the door stiles when the door is closed onto the mullion.

Figure 6:
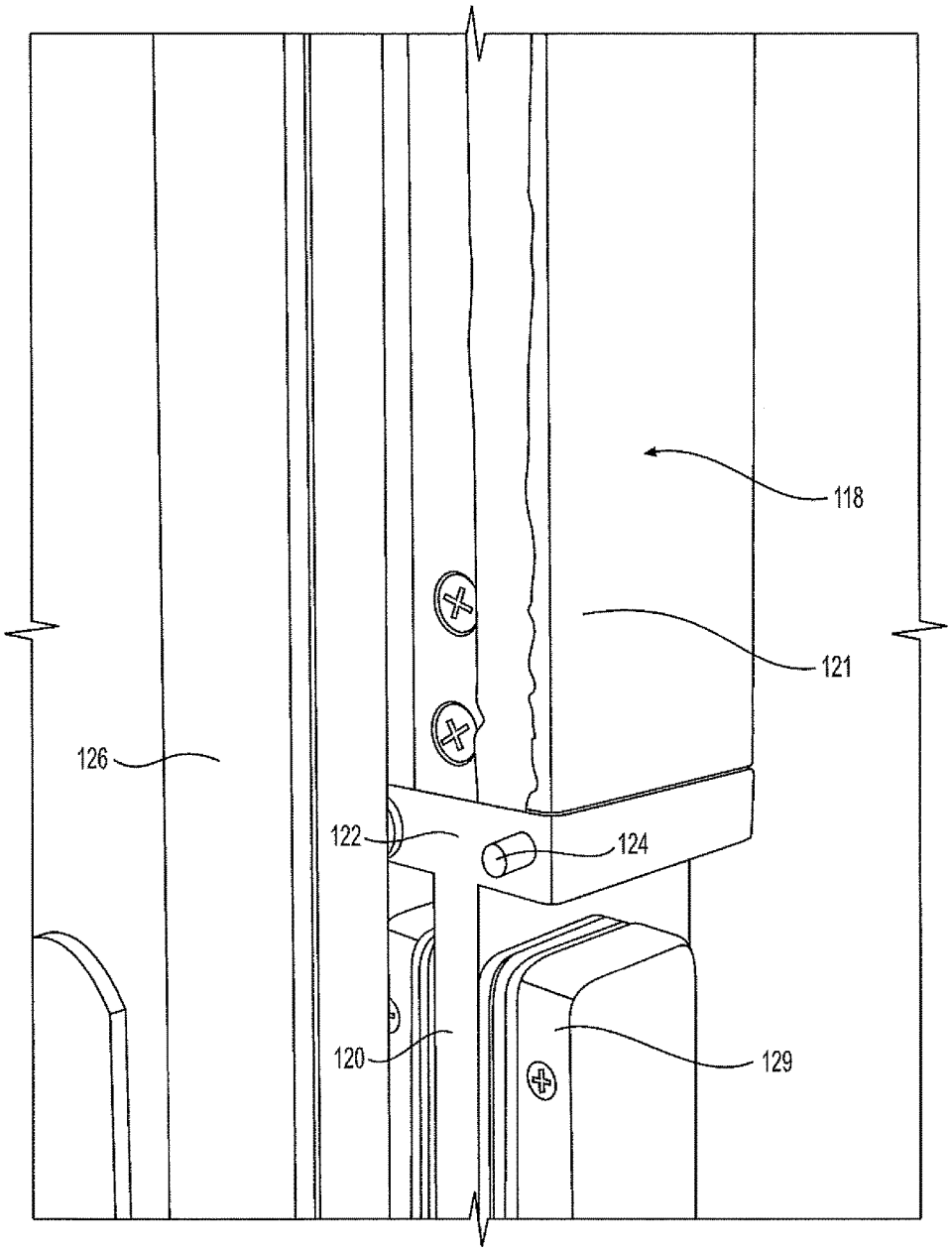
FIGS. 6 and 7 are perspective views of a mullion having a security stud shown (FIG. 6) and a narrow stile door having a metal grommet therein (FIG. 7) to receive the security stud.
Figure 7:
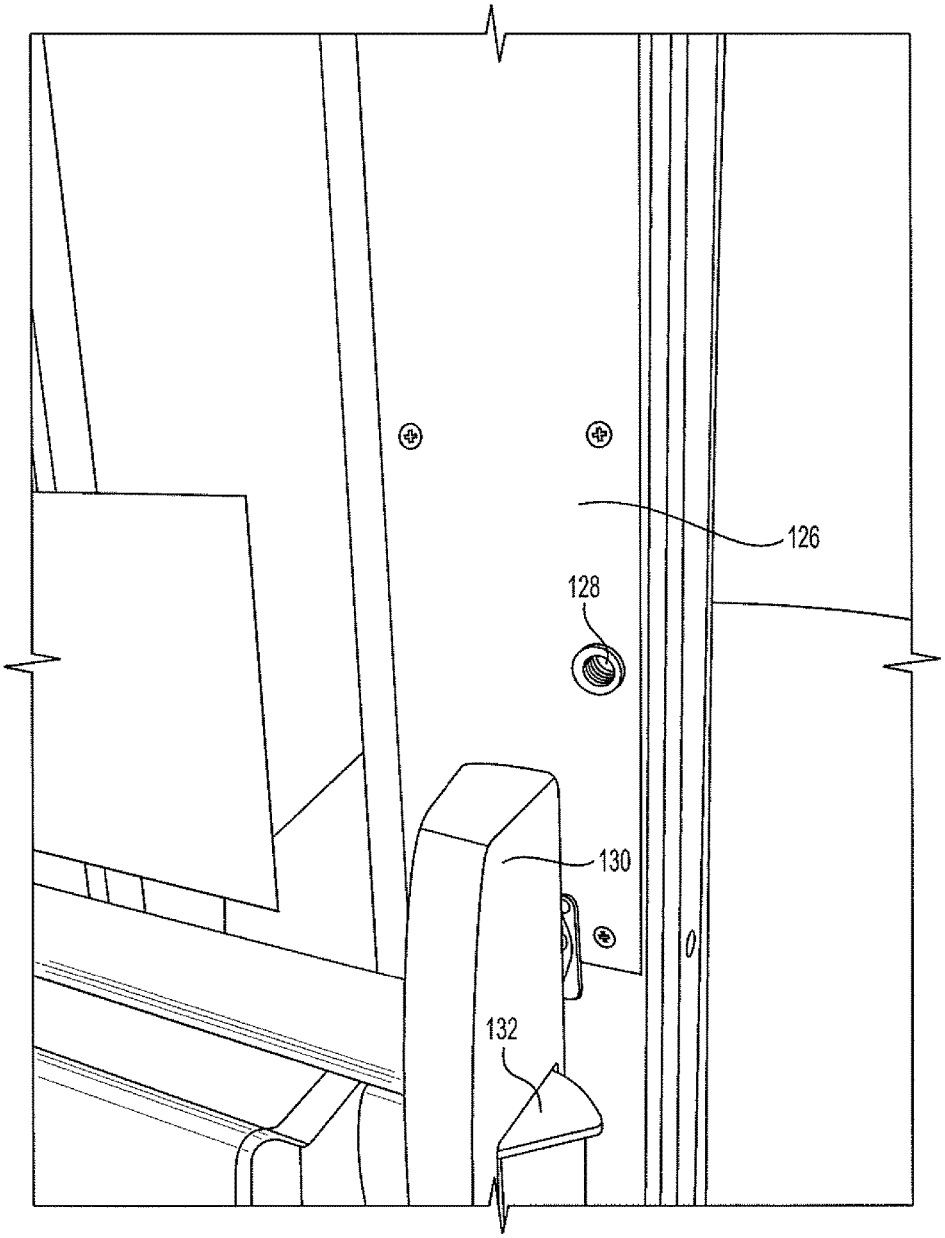

FIGS. 6 and 7 show a close-up view of a mullion 118 with a centerpiece 120 and the top flange face 122. Extending forward, or perpendicularly from the vertical orientation of the mullion 118 is a security stud 124 (FIG. 6). In FIG. 7, a grommet 128 is bored or drilled out of the stile 126. FIG. 7 also shows the push bar 130 and latch 132. When the stile 126 closes on the mullion 118, the latch 132 catches in the strike 129. Additionally, however, the security stud 124 slides into or fits into the grommet 128 or a countersunk hole and is retained in there. This security stud 124, therefore, adds strength and integrity to the door by preventing side movement of the mullion 118, thus adding strength to the overall assembly.

Other embodiments of the present invention will be apparent to those skilled in the art from consideration of the specification. It is intended that the specification and figures be considered as exemplary only, with a true scope and spirit of the invention being indicated by the claims.

That which is claimed is:

1. A mullion adapted for use in a narrow stile door system, the mullion comprising:

a mullion having a rectangular cross section with a first width, first depth and first height, and a flat front face that is adapted to face a door stile;

an I-shaped center section of the mullion having a thin, middle portion, wherein the depth of the I-shaped center section has a second depth that is approximately the same as the first depth of the rest of the mullion;

wherein thin, middle portion of the mullion has a second width of about ⅜$^{th}$ to one inch, the first depth is in the range of about 2 to 4 inches, and the middle portion of the mullion has a second height of about 8 to 12 inches; and the mullion is comprised of a single, monolithic piece of metal.

2. A mullion as described in claim 1, wherein the mullion further comprises a security stud that protrudes perpendicularly from the flat front face of the mullion and proximate, but not from, the I-shaped center section of the mullion.

3. A mullion as described in claim 1, wherein the middle portion of the mullion has a second width of about ½ of an inch.

4. A mullion adapted for use in a narrow stile door system, the mullion comprising:

a three-section mullion comprising top and bottom hollow mullion tubes and an I-shaped centerpiece;

wherein the top and bottom hollow mullion tubes have a first outside width and first outside depth and a second inside width and second inside depth, the second inside width and depth defined by the inside of the hollow tube walls;

wherein the I-shaped centerpiece is connected to and fixed in between the top and bottom mullion tubes;

further wherein the I-shaped centerpiece comprises a thin middle portion and top and bottom flanges, and the centerpiece further comprising top and bottom insert portions connected to the top and bottom flanges, and the top and bottom insert portions having a third width and third depth that are smaller than the second inside width and depth of the top and bottom hollow mullion tubes, with the insert portions adapted to be inserted into the hollow portion of the top and bottom mullion tubes and fixed therein.

5. A mullion adapted for use in a narrow stile door system as described in claim 4, wherein the centerpiece comprises top and bottom insert blocks and an I-shaped center portion, wherein the I-shaped center portion has the top and bottom flange portions on the top and bottom of the thin middle portion and the top and bottom insert blocks fixed to the top and bottom flanges on the opposite side of the flanges from the middle portion, whereby the top and bottom insert blocks form the insert portions of the centerpiece.

6. A mullion adapted for use in a narrow stile door system as described in claim 4, wherein the thin middle portion has an aperture therethrough its width and inside a depth and height of the middle portion to form the aperture.

7. A mullion adapted for use in a narrow stile door system as described in claim 6, further comprising a conduit channel that is an opening that extends from the top of an insert portion, through the flange and into the aperture in the middle portion, whereby the conduit channel is a pathway for electrical wiring.

8. A mullion adapted for use in a narrow stile door system as described in claim 4, wherein the centerpiece is formed of metal.

9. A mullion adapted for use in a narrow stile door system as described in claim 4, wherein the thin middle depth is substantially the same as the first outside depth of the top and bottom mullion tubes.

10. A mullion adapted for use in a narrow stile door system as described in claim 4, wherein the height of the thin middle is in the range of about 8 to 12 inches.

11. A mullion adapted for use in a narrow stile door system as described in claim 4, further comprising a security stud, wherein the top and bottom mullion tubes have substantially flat front width faces adapted to face a door stile, and wherein the top and bottom flanges each have flat front faces adapted to face a door stile, and the flange faces and the mullion faces are substantially parallel to each other, and the security stud protrudes perpendicularly from the flat front face of the top flange.

12. A mullion adapted for use in a narrow stile door system as described in claim 11, further comprising a plurality of security studs extending perpendicularly from the flat front face of the top flange.

* * * * *